United States Patent [19]

Evans

[11] 3,933,203

[45] Jan. 20, 1976

[54] CENTRALIZER FOR PRODUCTION STRING INCLUDING SUPPORT MEANS FOR CONTROL LINES

[76] Inventor: Orde R. Evans, P.O. Box 51303, O.C.S., Lafayette, La. 70501

[22] Filed: Mar. 27, 1975

[21] Appl. No.: 562,590

[52] U.S. Cl. ..... 166/241; 308/4 A

[51] Int. Cl.[2] ..... E21B 17/10

[58] Field of Search ..... 166/241, 189, 173, 106, 166/176, 72, 191; 175/104, 105; 308/4 A

[56] References Cited

UNITED STATES PATENTS

| | | | |
|---|---|---|---|
| 2,242,166 | 5/1941 | Bennett | 166/106 X |
| 2,594,551 | 4/1952 | Gist | 166/241 |
| 2,944,608 | 7/1960 | Rush | 166/241 |
| 2,959,453 | 11/1960 | Jacobs | 308/4 A |
| 3,170,520 | 2/1965 | Arutunoff | 166/189 X |
| 3,292,708 | 12/1966 | Mundt | 166/241 |
| 3,397,017 | 8/1968 | Grant et al. | 308/4 A |
| 3,566,963 | 3/1971 | Blackledge | 166/189 |
| 3,647,230 | 3/1972 | Smedley | 166/106 X |
| 3,844,345 | 10/1974 | Evans et al. | 166/72 |

*Primary Examiner*—David H. Brown
*Attorney, Agent, or Firm*—Jack W. Hayden

[57] ABSTRACT

An elastomer centralizer for a production string includes an elastomer body having a central opening extending longitudinally therethrough and a split in the body with the split extending to the opening in the body. A plurality of circumferentially spaced longitudinally extending projections are integrally formed on the body for positioning a production string within a well casing and an annular rib extends between predetermined pairs of the longitudinal projections with openings therein to provide an arrangement for supporting control lines extending from the earth's surface downwardly into the well bore.

5 Claims, 2 Drawing Figures

CENTRALIZER FOR PRODUCTION STRING INCLUDING SUPPORT MEANS FOR CONTROL LINES

SUMMARY OF THE INVENTION

Various types of centralizers are provided and are in use to position production strings in casing in a well bore. Control valves are provided in the production string for closing off flow through the production string should some malfunction occur so as to inhibit loss of fluid flow from the producing formation and to inhibit pollution should some malfunction occur.

Such control valves are generally operated or actuated from the earth's surface and at the present time are secured to the production string as the production string is connected and run into the well bore Quite often during such installation procedure, or during running of tools in the well, such control lines become fouled or damaged to the extent that they are rendered substantially inoperative so far as actuating the control valves in the production string when desired.

An object of the present invention is to provide a centralizer for the production string which is used in a well bore, which centralizer includes support means for supporting the control lines connected to one or more control valves in the production string.

Still another object of the present invention is to provide a centralizer for a production string in a well bore including an elastomer body having a split extending longitudinally thereof with a central longitudinal opening in the body also communicating with the split. The body includes a plurality of circumferentially spaced longitudinally extending projections with an annular rib extending between predetermined pairs of the projections, and openings through the rib which openings are aligned axially parallel to the longitudinal central opening in the body for receiving control lines therein to support such control lines in position in the well bore.

Other objects and advantages of the present invention will become more readily apparent from a consideration of the following description and drawings.

DESCRIPTION OF THE PREFERRED EMBODIMENTS

Figure 1:
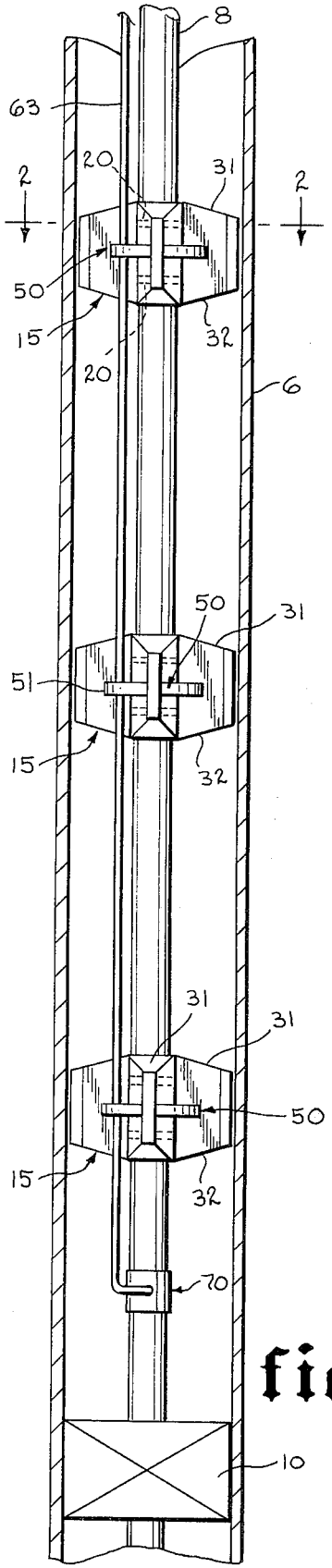
FIG. 1 is a sectional view illustrating a portion of a well bore with a casing therein and a production string positioned in the casing by means of the centralizer of the present invention and with a control line positioned in the rib opening in the centralizer of the present invention and connected to a control valve in the production string.

Attention is first directed to FIG. 1 of the drawings wherein a well casing is shown at 6. The production string 8 is positioned within the casing 6 and extends downwardly through a packer 10 to the producing formation for conducting well fluids to the earth's surface in a manner well known in the art.

The centralizer of the present invention is referred to generally by the numerical 15 in FIG. 1 and as shown in FIG. 1 is positioned at longitudinally spaced intervals of the production string to position the production string within the casing 6.

Figure 2:
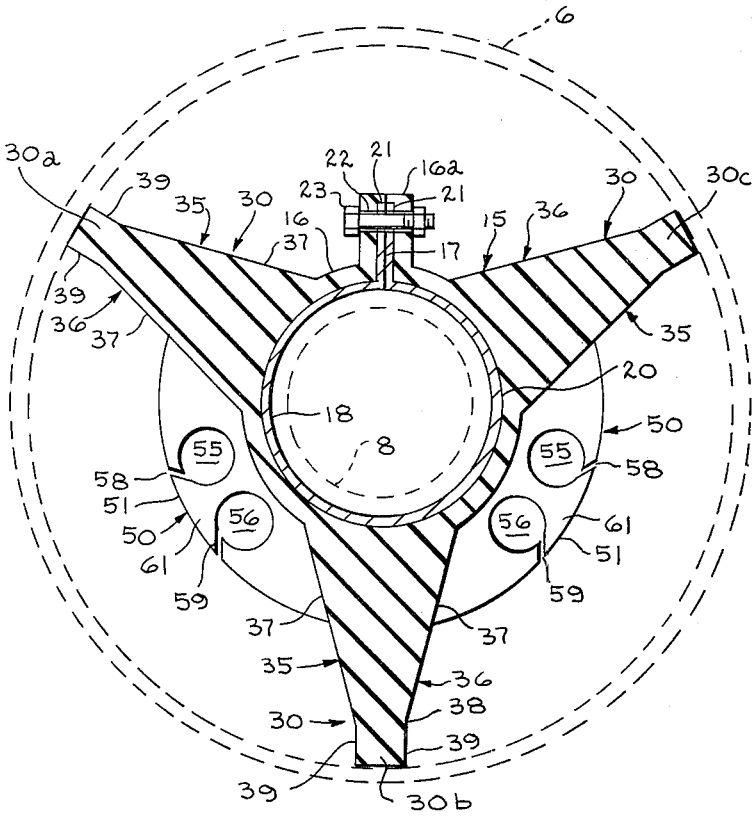
FIG. 2 is a sectional view on the line 2—2 of FIG. 1 illustrating further details of the present invention.

The structural details of the centralizer are better illustrated in FIG. 2 wherein the centralizer 15 is shown as being formed of a suitable elastomer such as polyurethane or the like and includes an annular body 16 which is split as illustrated at 17 to enable the centralizer to be positioned about the production string.

The body 16 is also provided with a central opening 18 for fitting about the production string 8 and the opening 18 communicates with the split 17 as shown in FIG. 2 of the drawings.

The body 16 includes a plurality, and as illustrated, two reinforcing rings 20 which are longitudinally spaced within the body 16 and are embedded in the elastomer body 16 immediately adjacent the opening 18 extending longitudinally therethrough. The annular or ring reinforcing members 20 may be formed of any suitable material such as metal, or other suitable reinforcing material and include a portion 21 at each end of the ring which extends substantially at right angles to the ring and to the body adjacent the split 17 formed in the body. The portions 21 of the reinforcing rings 20 each include openings 22 therein for receiving a suitable nut and bolt or other suitable means such as illustrated at 23 to lock the elastomer centralizer in position on the production string.

Each elastomer centralizer 15 also includes a plurality of longitudinally extending and circumferentially spaced projections represented generally by the numeral 30. As a practical matter, it has been found that three projections 30 serves the purpose quite well to position the production string 8 within the casing 6 while providing sufficient room between the projections 30 for passage of well tools.

It will also be noticed that the projections 30 are spaced equidistant circumferentially of the body 16 as shown in FIG. 2 of the drawings. In addition, the uppermost edge 31 of each of the projections 30 is inclined downwardly relative to the longitudinal axis of the annular body 16 and the lower edge 32 is inclined upwardly as shown in FIG. 1 of the drawings.

Each of the projections 30 have a pair of longitudinally extending side surfaces 35 and 36 within each side surface 35 and 36 including a first portion 37 extending at an angle from the body 16 to a predetermined point such as represented at 38 and an additional portion 39 extending parallel from the termination 38 of each of the first portions and in planes perpendicular to the body 16 as better seen in FIG. 2 of the drawings. The portions 37 are wider at their juncture with body 16 and converge outwardly to their termination at 38.

It will be noted that the split 17 in the body 16 and the portions 21 of the reinforcing rings 20 are positioned between a pair **30*a* and 30*c* of the projections 30 as shown in FIG. 2 of the drawings, and extending between each of the projections 30*a* and 30*b* and between 30*c* and 30*b* is an annular rib referred to generally at 50. The annular rib 50 between each of these projections extends in a plane substantially perpendicular to the elastomer body 16 and is provided with an outer circumferential edge 51 as shown in FIGS. 1 and 2 of the drawings. The annular rib 50 in effect extends between a pair of the projections 30 since the projection 30*a* and 30*b* form one pair between which the annular rib 50 extends, and the projection 30*b* along with the projection 30*c* defines another pair of projections between which the annular rib 50** also extends.

It can be appreciated that the elastomer body 16, projections 30 and annular rib 50 are integrally formed, as is the covering referred to at 16*a* for the portions 21 of the reinforcing rings 20.

The annular rib 50 formed on the body 16 includes a plurality of openings and it will be noted that each rib 50 between the projections is provided with a pair of openings 55 and 56, the central axis of which is parallel to the central axis of the longitudinal opening 18 in the body 16.

Each opening 55 and 56 is provided with a split 58 and 59 respectively extending from the outer edge of such opening to the circumferential edge 51 on the annular rib 50. Preferably, the splits 58 and 59 diverge outwardly from their intersection with the openings 55 and 56 respectively as shown in the drawings to provide a portion 61 of the annular rib between the splits which may be grasped and twisted out of the plane of the rib 50 to enable a control line to be selectively positioned in the openings 55 and 56.

For example, referring to FIG. 1, a control line 63 is shown which extends to the earth's surface, and normally a separate control line is provided for opening and closing of each safety valve, one of which is referred to generally at 70 in FIG. 1 in the production string 8. Also, it is generally the accepted practice to provide a plurality of such control valves in a production string and thus, a separate line may be received in each of the openings 55 and 56 of each annular rib 50 of the device shown in FIG. 2 of the drawings.

After the control lines have been positioned in the openings 55 and 56, the portion 61 reassumes its position relative to the circmferential edge 51 of the annular member 50 and serves to retain the control line in position adjacent the production string 8.

From the foregoing, it can be seen that the inner end of the splits 58 and 59 adjacent their innersection with the openings 55 and 56 respectively form a converging angle whereas their outer ends adjacent the circumferential edge 51 of the annular rib 50 form a diverging angle to enable the portion 61 to be flexed for positioning of the control lines 63 in each of the respective openings in the annular ribs.

This arrangement prevents the control lines from being fouled or tangled, and inhibits damage thereto during installation and during subsequent use in the well bore.

The foregoing disclosure and description of the invention are illustrative and explanatory thereof, and various changes in the size, shape, and materials as well as in the details of the illustrated construction may be made without departing from the spirit of the invention.

What is claimed is:

1. An elastomer centralizer for a production string comprising:

a. an elastomer body having a split extending longitudinally thereof;

b. said body having a longitudinally extending, central opening communicating with said split;

c. a plurality of longitudinally spaced rings molded in said body adjacent said longitudinal opening, said rings being split to coincide with the split in said elastomer body and having portions extending substantially at right angles to said rings at said split with an opening therethrough whereby said elastomer body may be closed and positioned on the production string;

d. said elastomer body having a plurality of projections extending longitudinally of said body in circumferentially spaced relationship;

e. an annular rib extending in a plane substantially perpendicular to said elastomer body between predetermined pairs of said projections and having a circumferential outer edge;

f. said rib having a plurality of openings extending therethrough in a plane parallel to the axis of the central opening through said elastomer body; and g. said rib having a separate split therein from its circumferential outer edge to each of the respective openings in said rib.

2. The invention of claim 1 wherein said body has three projections spaced equidistant circumferentially of said body; and wherein the split in said body is between two of the projections and wherein said annular rib extends from said two projections to the third projection.

3. The invention of claim 2 wherein each of said projections has a pair of longitudinally extending side surfaces with each side surface including a first portion extending at an angle from said body to a predetermined point and a continuous additional portion extending parallel from the termination of each of the first portions in planes perpendicular to said body.

4. The invention of claim 2 wherein two openings are provided in the annular rib between said two projections and said third projection.

5. The invention of claim 4 wherein the split in said annular rib to each of the openings extends to each of openings therein at a converging angle from said circumferential outer edge of said rib and in spaced relationship to enable the portion of the annular rib therebetween to be twisted relative to the plane of said rib for access to the pair of openings.

* * * * *

UNITED STATES PATENT OFFICE

CERTIFICATE OF CORRECTION

Patent No. 3,933,203 Dated January 20, 1976

Inventor(s) Orde R. Evans

It is certified that error appears in the above-identified patent and that said Letters Patent are hereby corrected as shown below:

Col. 2, line 22, "body adjacent" should be --body 16 adjacent--

Col. 2, line 44, "within" should be --with--

Signed and Sealed this thirtieth Day of March 1976

[SEAL]

Attest:

RUTH C. MASON
*Attesting Officer*

C. MARSHALL DANN
*Commissioner of Patents and Trademarks*